US011319649B2

(12) United States Patent
Archontopoulos et al.

(10) Patent No.: US 11,319,649 B2
(45) Date of Patent: May 3, 2022

(54) RING SPINNING SYSTEM AND METHOD FOR OPERATING

(71) Applicant: Uster Technologies AG, Uster (CH)

(72) Inventors: Vasileios Archontopoulos, Uster (CH); Sivakumar Narayanan, Uster (CH); Andreas Birsner, Winterthur (CH); Kurt Eggimann, Saland (CH); Paul Geiter, Pfaffikon (CH)

(73) Assignee: Uster Technologies AG, Uster (CH)

( * ) Notice: Subject to any disclaimer, the term of this patent is extended or adjusted under 35 U.S.C. 154(b) by 0 days.

(21) Appl. No.: 15/733,760

(22) PCT Filed: May 27, 2019

(86) PCT No.: PCT/CH2019/000016
§ 371 (c)(1),
(2) Date: Oct. 19, 2020

(87) PCT Pub. No.: WO2019/227241
PCT Pub. Date: Dec. 5, 2019

(65) Prior Publication Data

US 2021/0148012 A1 May 20, 2021

(30) Foreign Application Priority Data

May 28, 2018 (CH) ..... 00674/18

(51) Int. Cl.
*D01H 13/22* (2006.01)
*D01H 1/02* (2006.01)
*D01H 13/32* (2006.01)

(52) U.S. Cl.
CPC ..... *D01H 13/22* (2013.01); *D01H 1/02* (2013.01); *D01H 13/32* (2013.01)

(58) Field of Classification Search
CPC ..... D01H 13/32; D01H 1/02; D01H 9/18; B65H 63/006; B65H 67/063
See application file for complete search history.

(56) References Cited

U.S. PATENT DOCUMENTS 4,222,657 A 9/1980 Leuchter
4,660,370 A 4/1987 Matsui et al.
(Continued)

FOREIGN PATENT DOCUMENTS

DE 3712654 A1 10/1988
DE 4306095 A1 10/1993
(Continued)

OTHER PUBLICATIONS

English translation of WO9215737 to Lucca et al., Sep. 1992, obtained via espacenet.com (last visited Oct. 5, 2021) (Year: 2021).*
Uster Sentinel Brochure, Uster Technologies AG, 2016.

*Primary Examiner* — Shaun R Hurley
*Assistant Examiner* — Patrick J. Lynch
(74) *Attorney, Agent, or Firm* — Luedeka Neely Group, P.C.; Rick Barnes

(57) ABSTRACT

A method to operate a ring spinning system containing a ring spinning machine having spinning positions and a winding machine having winding positions. Yarn is spun at the spinning position and wound to a cop. Values of a spinning parameter are determined at different times during the winding of the cop and stored as spinning data. The cop is transported from the spinning position to the winding position, where the yarn is rewound from the cop onto a bobbin. Values of a yarn parameter are determined at at least two different times during the rewinding, and stored as yarn data. The spinning data and the yarn data are assigned to each other such that they relate to the same yarn section. Based
(Continued)

on the spinning data and yarn data assigned, an intervention is made on the ring spinning machine.

21 Claims, 4 Drawing Sheets

(56) References Cited

U.S. PATENT DOCUMENTS

| | | | | | |
|---|---|---|---|---|---|
| 4,843,808 | A * | 7/1989 | Ruge | B65H 63/006 | 57/264 |
| 5,107,667 | A | 4/1992 | Tone et al. | | |
| 5,381,340 | A * | 1/1995 | Ueda | B65H 67/06 | 57/264 |
| 2009/0223199 | A1* | 9/2009 | Wassenhoven | D01H 13/32 | 57/362 |
| 2013/0346007 | A1* | 12/2013 | Schmid | G01N 33/365 | 702/84 |

FOREIGN PATENT DOCUMENTS

| | | | | |
|---|---|---|---|---|
| DE | 4209203 | | 11/2005 | |
| EP | 3293295 | A1 | 3/2018 | |
| EP | 3305700 | A1 | 4/2018 | |
| WO | 9215737 | A1 | 9/1992 | |
| WO | WO-2007056883 | A2 * | 5/2007 | G01N 33/365 |
| WO | 2009073993 | A1 | 6/2009 | |
| WO | WO-2010009565 | A1 * | 1/2010 | D01H 13/22 |
| WO | 2014022189 | A1 | 2/2014 | |
| WO | 2014051730 | A1 | 4/2014 | |

* cited by examiner

RING SPINNING SYSTEM AND METHOD FOR OPERATING

FIELD OF THE INVENTION

The present invention lies in the field of ring spinning and especially quality control in ring spinning. It relates to a ring spinning system and a method for its operation, according to the independent patent claims.

DESCRIPTION OF THE PRIOR ART

A ring spinning system usually contains a ring spinning machine and a winding machine.

The ring spinning machine has a plurality of spinning positions. At each spinning position, roving is unwound from a roving bobbin, stretched, twisted (spun) and wound as yarn onto a cop (yarn bobbin). Systems for monitoring the operation of the spinning positions, e.g. for detecting yarn break or "slip spindles" (i.e. spindles that operate at a speed below the set machine speed), are known. Such spinning monitoring systems typically measure the rotational speed of the respective ring traveler (e.g. U.S. Pat. No. 4,222,657 A) or the yarn (e.g. WO-2014/022189 A1). The former category includes the ring spinning optimization system USTER® SENTINEL, which is described in the brochure "USTER® SENTINEL—The ring spinning optimization system", Uster Technologies AG, 2016. The ring spinning optimization system USTER® SENTINEL generates a cop build-up report, which graphically displays, among other things, the average number of yarn breaks and the average speed of rotation as a function of the position along a longitudinal axis of a cop. The cop build-up report is displayed on a screen to an operator.

EP-3'293'295 A1 discloses a measuring system for a spinning machine. A sensor is arranged at each spinning position. From its signals, production parameters such as the presence of the yarn or the yarn speed on the one hand and quality parameters such as mass, thickness or reflectivity of the yarn on the other hand are determined. These parameters are transmitted to an information system, which compiles, processes and outputs information therefrom.

After their production, the cops are transported from the ring spinning machine to a winding machine. Cop tracking systems are known which make it possible to assign a cop in the winding machine to the spinning position on which it was produced. The assignment can be made, for example, by means of an identification carrier on the cop ring tube (e.g. U.S. Pat. No. 4,660,370 A) or on a bobbin plate (caddy) which transports the cop (e.g. DE-42'09'203 A1).

The winding machine has a large number of winding positions. At each winding position several cops are rewound one after the other onto a cross-wound bobbin. The purpose of rewinding is to produce large yarn bobbins that can be transported and used efficiently. During the rewinding process, the properties of the yarn are monitored and compared with predefined quality criteria. If the quality criteria are not met, the defective part can be removed from the yarn. So-called yarn clearing systems are known for this purpose, e.g. from WO-2012/051730 A1.

U.S. Pat. No. 5,107,667 A proposes a spinning frame management method. The spinning system is equipped with a cop tracking system. Yarn defects are detected when the yarn is rewound on the winder. By means of the cop tracking system, faulty spinning positions of the ring spinning frame are detected.

DE-43'06'095 A1 discloses a method and a device for controlling a networked spinning installation. The spinning installation comprises a ring spinning machine, a service robot assigned to the ring spinning machine and a winding machine with a yarn clearer linked to the ring spinning machine. It is equipped with a cop tracking system. Information is exchanged to optimize the spinning installation. The service robot not only carries out service operations, but also collects information on the status of the spinning positions and yarn breaks in the individual cops. The winding machine or its yarn clearers can use the cop tracking system to determine that a particular spindle of the ring spinning machine is consistently producing bad yarn.

WO-2009/073993 A1 proposes a device and a method for monitoring a plurality of working positions of a ring spinning machine. The device has at least one yarn tester, which is arranged at a further processing machine for the yarn, and a monitoring unit, which is connected to the yarn tester. In order to ensure identification of the working positions of the ring spinning machine, a probe for contactless recording of signals, which can be moved past the working positions, is provided, which is connected to the monitoring unit and has a first sensor for monitoring the working positions and a second sensor for data recording on cop ring tubes at the working positions.

SUMMARY OF THE INVENTION

It is an object of the present invention to indicate a ring spinning system and a method for its operation which achieve a higher productivity and at the same time a desired quality level of the spun yarn. In particular, the quality of the yarn shall be essentially the same on the whole cop or at least its variation shall be reduced. The service life of replaceable machine parts should be increased.

These and other objects are solved by the method and ring spinning system as defined in the independent patent claims. Advantageous embodiments are specified in the dependent patent claims.

The invention is based on the idea of, for a cop, automatically assigning to each other corresponding, time-resolved values of a parameter characteristic of the operation of the spinning position and values of a parameter characteristic of the yarn in such a way that they relate to the same yarn section, and to carry out an intervention at the ring spinning machine on the basis of the assignment. Preferably, the time-resolved values assigned to each other are displayed graphically, and the graphical representation is output to an operator in a visually detectable form.

In this specification, the term "yarn section" relates to a contiguous real subset of the yarn on a cop. The length of such a yarn section can be between approx. 1 mm and a large part of the total length on the cop.

The method according to the invention serves to operate a ring spinning system which comprises a ring spinning machine with a plurality of spinning positions and a winding machine with a plurality of winding positions. Yarn is spun at one of the spinning positions and wound into a cop. The cop is automatically transported from the spinning position to one of the winding positions. At the winding position, the yarn is rewound from the cop onto a yarn bobbin. Values of a parameter characteristic for the operation of the spinning position are automatically determined at at least two different times during the winding of the cop and stored as spinning data together with associated first section information identifying the yarn sections wound at the at least two different times. Values of a parameter characteristic of the yarn are automatically determined at least two different times during rewinding of the cop and stored as yarn data together with associated second section information identifying the yarn sections rewound at the at least two different times. The spinning data and the yarn data are automatically assigned to each other based on the respective first and second section information in such a way that they relate to the same yarn section. An intervention is made on the ring spinning machine based on the spinning data and yarn data assigned to each other.

In one embodiment, yarn is simultaneously spun at a plurality of spinning positions and wound into cops, which cops form a group of cops. The values of the parameter characteristic for the operation of the spinning position are automatically determined for the whole group of cops at the same time. A mean value of the values of the parameter characteristic for the operation of the spinning position is calculated for the group of cops for each of the different times, and these mean values are stored as spinning data together with associated first section information. A mean value of the values of the parameter characteristic of the yarn is automatically calculated for the same group of cops for each of the different times, and these mean values are stored as yarn data together with associated second section information.

In one embodiment, the first and/or second section information contains information about a point in time when the respective yarn section is wound or rewound and/or information about a location on the cop where the respective yarn section is located.

In one embodiment, an identification of a point in time when the cop or group of cops is wound up is assigned to the cop or group of cops for the mutual automatic assignment of the spinning data and the yarn data, and is stored as a key with both the spinning data and the yarn data. For the mutual automatic assignment of the spinning data and the yarn data, an additional identification of the spinning position can be assigned to the cop and stored as a key with both the spinning data and the yarn data.

The intervention on the ring spinning machine comprises, for example, an action from the following set: changing a spindle speed preset, changing a ring traveler, changing a drafting belt, changing a pressure cylinder, changing the air temperature, changing the air humidity.

The parameter characteristic of the operation of the spinning position, which is comprised by the spinning data, is selected from the following set, for example: number of yarn breaks per time unit, ring traveler speed, air temperature, air humidity.

The parameter characteristic of the yarn comprised by the yarn data is selected, for example, from the following set: coefficient of variation of the yarn mass, coefficient of variation of the yarn diameter, hairiness, number of thick places per unit length, number of thin places per unit length, number of periodic yarn faults per unit length, number of yarn count variations per unit length, number of foreign materials per unit length.

The intervention at the ring spinning machine can be carried out automatically.

In one embodiment, the spinning data and yarn data assigned to each other are graphically displayed together in a graphical representation, and the graphical representation is output to an operator in a visually detectable form as the basis for the intervention to be carried out on the ring spinning machine. A recommendation for the intervention at the ring spinning machine can be generated automatically and output to the operator in addition to the graphical representation. The intervention at the ring spinning machine can be carried out by the operator on the basis of the graphical representation output or on the basis of the recommendation. The graphical representation of the spinning data preferably contains a diagram of the at least two values of the parameter characteristic for the operation of the spinning position as a function of the position along a longitudinal axis of a cop or as a function of the time during the winding of one and the same cop, and the graphical representation of the yarn data preferably contains a diagram of the at least two values of the parameter characteristic for the yarn as a function of the same independent variable as the spinning data. The graphical representation may additionally contain a diagram representing a quantity from the following set: operating time of a ring traveler, operating time of a pressure cylinder, operating time of a drafting belt.

In one embodiment, the operation of the ring spinning system is controlled in a closed control loop, in which control loop the parameter characteristic for the operation of the spinning position and/or the parameter characteristic for the yarn is a controlled variable and the target state is that the values of the parameter or of the parameters are within a predetermined target range.

The ring spinning system according to the invention comprises a ring spinning machine having a plurality of spinning positions for spinning yarn and winding the yarn onto a cop each and a spinning monitoring system for monitoring the operation of the spinning positions, with a spinning sensor at each of the spinning positions for measuring a spinning measured quantity. The ring spinning system further contains a winding machine with a plurality of winding positions for rewinding the yarn from a respective cop onto a yarn bobbin and a yarn monitoring system for monitoring properties of the yarn, with a yarn sensor at each of the winding positions for measuring a yarn measured quantity. The ring spinning system also contains a transport system for transporting the cop from the spinning position to one of the winding positions. The ring spinning system contains a spinning monitoring control unit connected to the spinning sensor, which is arranged to receive values of the spinning measured quantity from the spinning sensor of a spinning position, to determine therefrom, at at least two different times during the winding of the cop, values of a parameter characteristic for the operation of the spinning position and to store the determined values together with associated first section information, which identifies the yarn sections wound at the at least two different times, as spinning data. The ring spinning system contains a yarn monitoring control unit connected to the yarn sensor, which is adapted to receive values of the yarn measured quantity from the yarn sensor of a winding position, to determine therefrom, at at least two different times during the rewinding of a cop in each case, values of a parameter characteristic of the yarn and to store the determined values together with associated second section information, which identifies the yarn sections rewound at the at least two different times, as yarn data. The ring spinning system also contains a central control and evaluation device connected to the spinning monitoring control unit and to the yarn monitoring control unit, which is adapted to receive the spinning data from the spinning monitoring control unit and the yarn data from the yarn monitoring control unit and to assign the received spinning data and yarn data to each other on the basis of the respective first and second section information in such a way that they relate to the same yarn section, in order to thereby provide a basis for intervention on the ring spinning machine.

In one embodiment, the central control and evaluation unit is connected to a control unit of the ring spinning machine and is adapted to automatically perform the intervention on the ring spinning machine.

In one embodiment, the central control and evaluation unit is connected to an output unit and is adapted to graphically display the spinning data and yarn data assigned to each other together in a graphical representation and to output the graphical representation in a visually detectable form on the output unit to an operator as a basis for the intervention to be carried out on the ring spinning machine.

In one embodiment, the central control and evaluation unit is adapted to automatically generate a recommendation for intervention on the ring spinning machine and to output it to the operator in addition to the graphical representation.

In one embodiment, the ring spinning system comprises several spinning monitoring systems whose spinning monitoring control units are connected to a spinning expert system, which is adapted to receive, process and output data from the spinning monitoring control units in a suitable form and to control the spinning monitoring control units, and which is connected to the central control and evaluation device.

In one embodiment, the ring spinning system comprises several yarn monitoring systems, whose yarn monitoring control units are connected to a yarn expert system, which is adapted to receive, process and output data from the yarn monitoring control units in a suitable form and to control the yarn monitoring control units, and which is connected to the central control and evaluation unit.

One advantage of the invention is the increase in productivity while maintaining the desired quality level of the spun yarn. Settings on the ring spinning machine are optimally adjusted, thus increasing the yarn quality and increasing productivity. A consistent yarn quality is achieved throughout the cop. Thanks to the invention, systematic quality deviations in the yarn are detected more quickly and their cause is eliminated. The temporal resolution of the spinning data and the yarn data and their mutual assignment enable a differentiated intervention on the ring spinning machine. The invention makes it possible to optimize the service life of parts of the ring spinning machine or consumables on it by not having to replace them too early as a precaution, but also by not replacing them too late, which would lead to a reduction in productivity and/or quality. The invention offers the operating personnel the opportunity to gain new insights into the relationships between spinning data and yarn data and, thanks to these, to further optimize the spinning process. Effects of an intervention on the ring spinning machine can be observed and recorded over a long period of time. Several ring spinning machines operating simultaneously can be compared with each other, which makes it possible to differentiate in particular between machine-related influences and other influences such as raw material or ambient conditions.

BRIEF DESCRIPTION OF THE DRAWINGS

In the following, the invention is explained in detail on the basis of the drawings.

IMPLEMENTATION OF THE INVENTION

Figure 1:
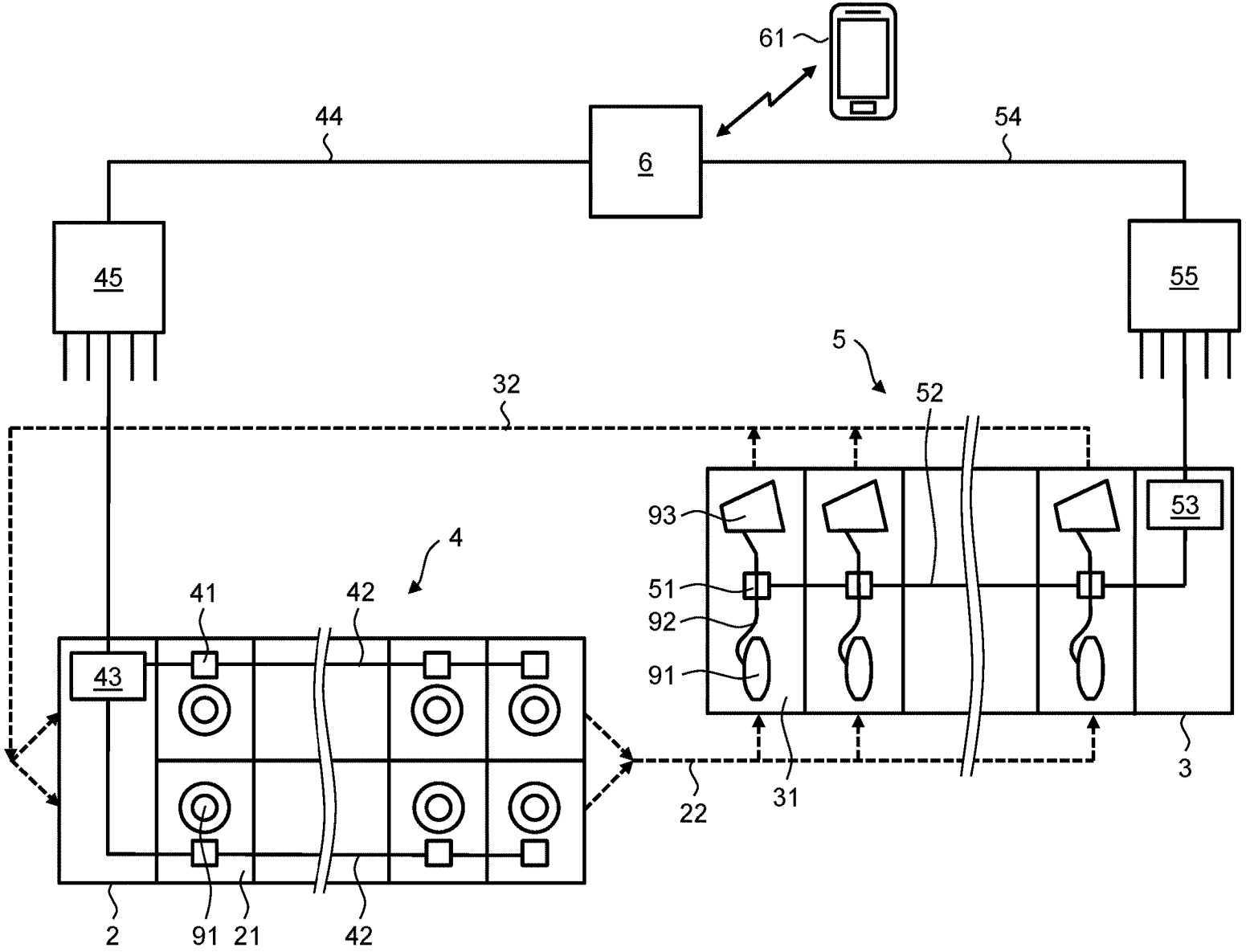
FIG. 1 shows schematically a ring spinning system according to the invention.

FIG. 1 shows a schematically a ring spinning system 1 according to the invention. The ring spinning system 1 contains a ring spinning machine 2 and a winding machine 3.

The ring spinning machine 2 comprises a plurality of spinning positions 21. At each spinning position 21, yarn is spun from roving by means of the well-known ring spinning process and wound into a so-called cop 91. The ring spinning machine 2 is equipped with a spinning monitoring system 4 for monitoring the operation of spinning positions 21, e.g. for detecting yarn breaks or "slip spindles". The spinning monitoring system 4 contains a spinning sensor 41 at each of the spinning positions 21. The spinning sensor 41 measures a spinning measured quantity. Each spinning sensor 41 is connected to a spinning monitoring control unit 43 via a wired or wireless first data line 42. The spinning sensor 41 sends values of the spinning measured quantity to the spinning monitoring control unit 43 via the first data line 42. The spinning monitoring control unit 43 receives the values. It determines values of a parameter characteristic for the operation of spinning position 21 from these values for at least two different times during the winding of the cop 91 and stores the determined values together with associated first section information, which identifies the yarn sections wound at the at least two different times, as spinning data. Examples of the parameter characteristic for the operation of spinning position 21 are a number of yarn breaks per unit of time, a ring traveler speed, an air temperature and an air humidity.

The spinning data may refer to a specific cop 91 or to a group of cops 91 produced simultaneously, e. g. cops 91 of several spinning positions 21 of ring spinning machine 2 with the same article, or cops 91 of all spinning positions 21 of ring spinning machine 2. If the spinning data refer to a group of cops 91, a mean value of the values of all cops 91 of the group is calculated for each of at least two different times and these mean values are stored as spinning data together with associated first section information.

The full, simultaneously produced cops 91 are simultaneously set down ("doffed") by ring spinning machine 2 and then automatically transported to winding machine 3, as indicated by dashed arrows 22 in FIG. 1.

The winding machine 3 has a large number of winding positions 31. At each winding position 31, yarn 92 is rewound from several cops 91 one after the other onto a yarn bobbin 93, e.g. a cross-wound bobbin. The winding machine 3 is equipped with a yarn monitoring system 5 for monitoring the properties of the yarn 92. The yarn monitoring system 5 contains a yarn sensor 51 at each of the winding positions. The yarn sensor 51 measures a yarn measured quantity. Each yarn sensor 51 is connected to a yarn monitoring control unit 53 via a wired or wireless second data line 52. The yarn sensor 51 transmits values of the measured yarn count to the yarn monitoring control unit 53 via the second data line 52. The yarn monitoring control unit 53 receives the values. It determines values of a parameter characteristic for the yarn for at least two different times during the rewinding of the cop 91 and stores the determined values together with associated second section information, which identifies the yarn sections rewound at the at least two different times, as yarn data. Examples of the parameter characteristic for the yarn 92 are a coefficient of variation of the yarn mass, a coefficient of variation of the yarn diameter, a hairiness, a number of thick places per unit length, a number of thin places per unit length, a number of periodic yarn defects per unit length, a number of yarn count variations per unit length and a number of foreign substances per unit length. The yarn monitoring system 5 can, for example, be designed as a yarn clearing system, wherein each yarn sensor 51 can be assigned a yarn cutting unit that removes impermissible yarn defects from yarn 92.

The yarn data relate to the same cop 91 or the same group of cops 91 as the spinning data. If the spinning data relate to a group of cops 91, a mean value of the values of all cops 91 in the group is calculated for each of at least two different times, and these mean values are stored as yarn data together with the corresponding second section information.

Empty cop ring tubes are removed from the winding machine 3 and returned to the ring spinning machine 2, as indicated in FIG. 1 with dashed arrows 32.

The ring spinning system 1 in accordance with the invention further comprises a central control and evaluation unit 6. The central control and evaluation unit 6 is connected to the spinning monitoring control unit 43 via a wired or wireless third data line 44 and receives the spinning data from this unit. The central control and evaluation unit 6 is also connected to the yarn monitoring control unit 53 via a wired or wireless fourth data line 54 and receives the yarn data from this unit. The central control and evaluation unit 6 assigns the received spinning data and yarn data to each other based on the respective first and second section information in such a way that they relate to the same yarn section. In this way, it provides a basis for intervention on the ring spinning machine 2. The spinning data and yarn data to be assigned to each other must relate to the same cop 91 or the same group of cops 91. This can be ensured by assigning an identification of a time of unwinding cop 91 or the group of cops 91 to cop 91 or the group of cops 91 and storing it as a key together with both the spinning data and the yarn data. Such an identification of a point in time of unwinding cop 91 or the group of cops 91 can, for example, be a so-called doff number, i.e. a natural number that uniquely identifies a doff of cops 91 produced simultaneously by the ring spinning machine 2 and that is increased by one for each subsequent doff.

The ring spinning system 1 is preferably equipped with a cop tracking system (not drawn), which makes it possible to assign a cop 91 located in the winding machine 3 to the spinning position 21 on which it was produced. Such cop tracking systems are known per se and will not be discussed further here. If available, the cop tracking system can be used for the above-mentioned identification of a time of unwinding cop 91 or the group of cops 91. It can provide the identification of the central control and evaluation unit 6. In addition, it can assign an identification of the spinning position 21, on which a certain cop 91 was produced, to the cop 91 and make the assignment available to the central control and evaluation device 6. The central control and evaluation device 6 can also store this identification as a key with both the spinning data and the yarn data, in order to enable or facilitate the mutual assignment of the spinning data and the yarn data.

The central control and evaluation unit 6 can be designed as an independent device, e.g. as a computer located inside or outside the spinning mill. Alternatively, the central control and evaluation unit 6 can be integrated in another device, e.g. in a yarn testing device in the textile laboratory of the spinning mill, in the spinning monitoring control unit 43, in the yarn monitoring control unit 53, etc. In the latter two cases, there may be a direct data connection between the spinning control unit 43 and the yarn monitoring control unit 53, via which the two control units 43, 53 transmit or exchange data. The central control and evaluation unit 6 is preferably connected to an input unit and/or an output unit via which an operator can make inputs or receive outputs. In the exemplary embodiment of FIG. 1, a mobile device 61, e.g. a cell phone, which communicates wirelessly with the central control and evaluation unit 6, is drawn as input and output unit. Alternatively or additionally, other input units known per se, e.g. a computer keyboard and output units such as a computer screen, can be used.

Along the third data line 44 and/or the fourth data line 54, there may be further devices which receive the transmitted data, process it if necessary and retransmit it. In one embodiment, the ring spinning system 1 contains several spinning monitoring systems 4 on one or more ring spinning machines 2, whose spinning monitoring control units 43 are connected to a spinning expert system 45. The spinning expert system 45 is adapted to receive, process and output data from the spinning monitoring control units 43 in a suitable form and to control the spinning monitoring control units 43. It is in turn connected to the central control and evaluation unit 6.

In one embodiment, the ring spinning system 1 comprises several yarn monitoring systems 5 on one or more winding machines 3, whose yarn monitoring control units 53 are connected to a yarn expert system 55. The yarn expert system 55 is adapted to receive, process and output data from the yarn monitoring control units 53 in a suitable form and to control the yarn monitoring control units 53. It is in turn connected to the central control and evaluation unit 6.

The mutual assignment of the spinning data and the yarn data provides a basis for an intervention on the ring spinning machine 2. On the one hand, such an intervention can take place automatically. On the other hand, the intervention can be carried out by an operator. For the latter purpose, the spinning data and yarn data assigned to each other are displayed together graphically, and the graphical representation of the spinning data and yarn data assigned to each other is output to the operator in a visually detectable form as a basis for the intervention to be carried out on ring spinning machine 2. Examples of graphical representations are given in FIGS. 2-4.

Figure 2:
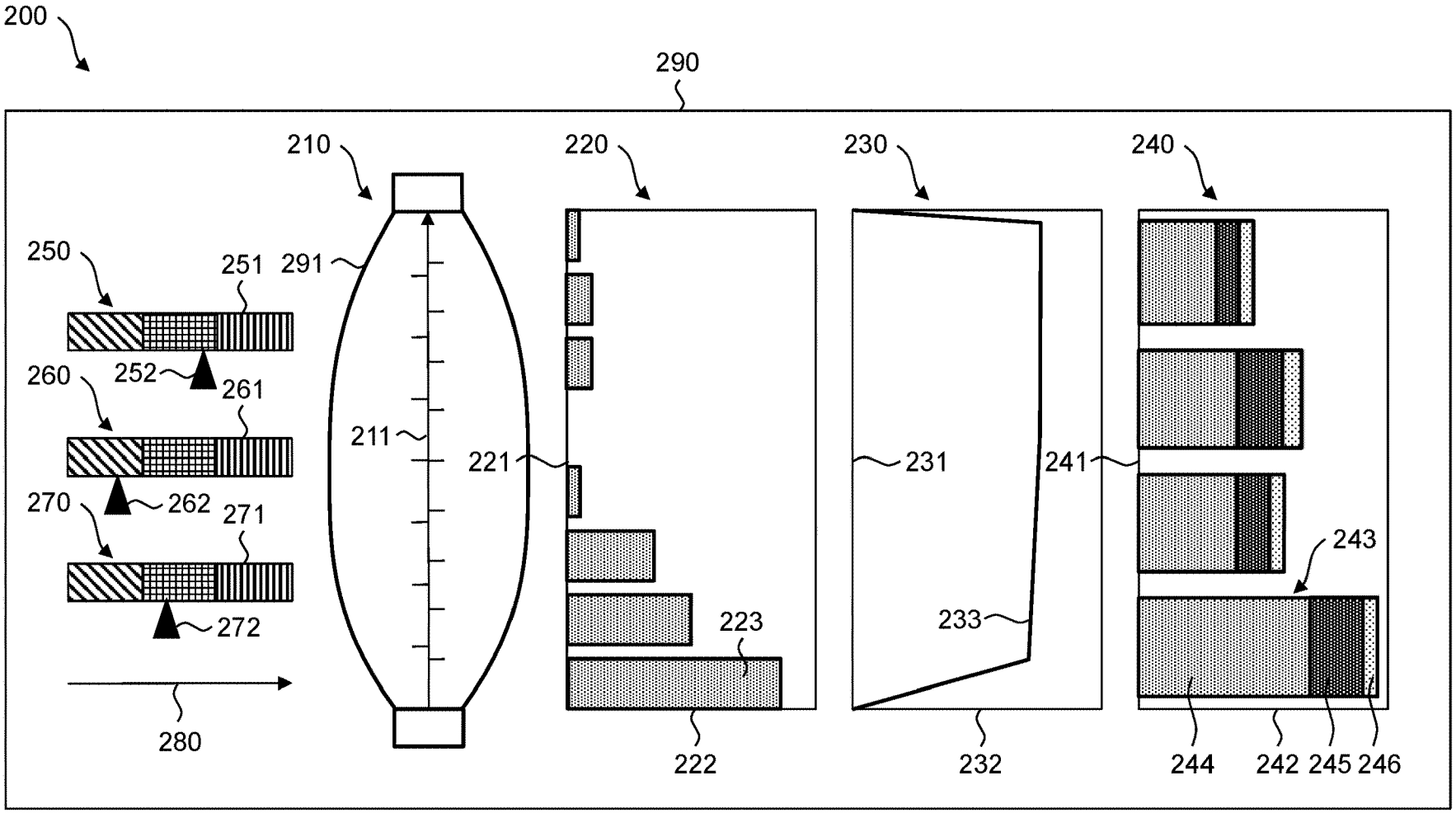
FIGS. 2-4 show examples of graphical representations as they can be output in the method according to the invention.

FIG. 2 shows a first example of a graphical representation 200 of the mutually assigned spinning data and yarn data, as can be output in a visually perceivable form to an operator. The data is output on a known output unit, e.g. mobile device 61, connected to the central control and evaluation unit 6 (see FIG. 1).

The representation 200 contains a schematic representation 210 of a cop 291, which was wound from bottom to top. To the right of the representation 210 of the cop 291 are three diagrams 220, 230, 240, whose vertical axes 221, 231, 241 correspond in each case to the longitudinal axis (axis of rotation) of cop 291. The vertical axes 221, 231, 241 thus essentially indicate a time course during which the cop 291 was wound up. However, they can just as well indicate a time course during the rewinding of cop 291, a position along the longitudinal axis of cop 291, a length of the yarn wound on cop 291, a mass of the yarn wound on cop 291, etc. An axis 211 drawn in the cop 291 with two different pitches indicates that there are several different, but essentially corresponding possibilities for defining the independent variables applied along the vertical axes 221, 231, 241.

In a first diagram 220 of the representation 200, a number of yarn breaks per time unit 222 as a function of time 221 during the winding of the cop 291 is shown with bars 223. Each bar 223 corresponds to a certain time unit during winding, e.g. 20 minutes, or a certain yarn length, e.g. 250 m. At the beginning of the cop production, there were relatively many yarn breaks in this example, later less. This first diagram 220 shows spinning data.

In a second diagram 230, a temporal course of a ring traveler speed 232 during cop production is shown with a line 233. At the beginning of the cop production, the ring traveler is accelerated evenly. After reaching a given speed, this speed is essentially maintained for the rest of the cop production. At the end of the cop production, the speed is slowed down to zero. The ring traveler speed can be determined in various ways, e.g. from a signal from spinning sensor 41 (see FIG. 1) or from the speed of a rotor of a motor driving the spindle. This second diagram 230 also shows spinning data.

In a third diagram 240, a number of yarn faults per time unit 242 as a function of time 241 during rewinding of the cop is shown with bars 243, wherein the time axis 241 is scaled so that the total rewinding time is equal to the total cop production time. Each bar 243 corresponds to a certain time unit, e.g. 40 seconds during rewinding or 40 minutes during winding up, or a certain yarn length, e.g. 1000 m. Each bar 243 is divided into three sections 244-246 in the exemplary embodiment of FIG. 2, representing different types of yarn faults, e.g. neps 244, thin places 245 and thick places 246. The number of bars 243 in this third diagram 240 need not be the same as in the first diagram 220. The yarn at the bottom of cop 291 has more yarn faults than the rest of the yarn. This third diagram 240 represents yarn data, which are thus assigned to the spinning data of the first diagram 220 and the second diagram 230, in such a way that they both relate to the same yarn section.

The dependent variables shown in the three diagrams 220, 230, 240 can relate to a single cop or to a group of cops. In the latter case, diagrams 220, 230, 240 each show mean values of the respective variables obtained from averaging over the entire group. The diagram 210 of the cops 291, which is only schematic anyway, then represents the group of cops.

The time-resolved spinning data and yarn data, which are assigned to each other and, if necessary, graphically displayed together, allow the ring spinning process to be optimized. Based on the spinning data and yarn data assigned to each other, it is possible to assess whether and, if necessary, what kind of intervention is to be carried out on the ring spinning machine 2. Such an intervention can, for example, involve a change in a spindle speed, an exchange of a ring traveler, an exchange of a drafting belt, an exchange of a pressure cylinder, a change in air temperature and/or a change in air humidity.

In addition to the output of the graphical representation 200 according to FIG. 2, a recommendation for the intervention at the ring spinning machine 2 can be automatically generated and output to the operator. The output of the recommendation can be in a visually detectable form, e.g. as text in the graphical representation 200, or in another form, e.g. acoustically.

To the left of the cop 291, the graphic representation 200 of FIG. 2 shows three diagrams 250, 260, 270, each of which illustrates an operating time of a component of spinning position 21. Each of these diagrams 250, 260, 270 shows a bar 251, 261, 271. Each bar 251, 261, 271 is divided into three areas, which can have the traffic light colors green, yellow or red, for example. An arrow 252, 262, 272 below the bar 251, 261, 271 shows the operating time of the component and moves from left to right along a time axis 280 as the operating time increases. If the arrow 252, 262, 272 is in the first, green area, the component is relatively new and should function properly. If the arrow 252, 262, 272 in the second, yellow area, the component should be replaced soon. The arrow 252, 262, 272 the third, red area indicates that the average lifetime of the component has been exceeded and the component should be replaced as soon as possible. The components whose operating time is indicated may be, for example, the ring traveler, the pressure cylinder or the drafting belt of the spinning position. Corresponding to the diagrams 220, 230, 240 to the right of the cop 291, these diagrams 250, 260, 270 may refer to a single cop or to a group of cops. Such diagrams can additionally support the decision on a possible intervention on the ring spinning machine 2.

A frame 290 comprising all the elements of representation 200 indicates the visual comprehensibility of the graphical representation 200. In particular, the diagrams 220, 230, 240, which represent the spinning data and yarn data assigned to each other, should be output simultaneously and close together, e.g. on the same screen page.

Figure 3:
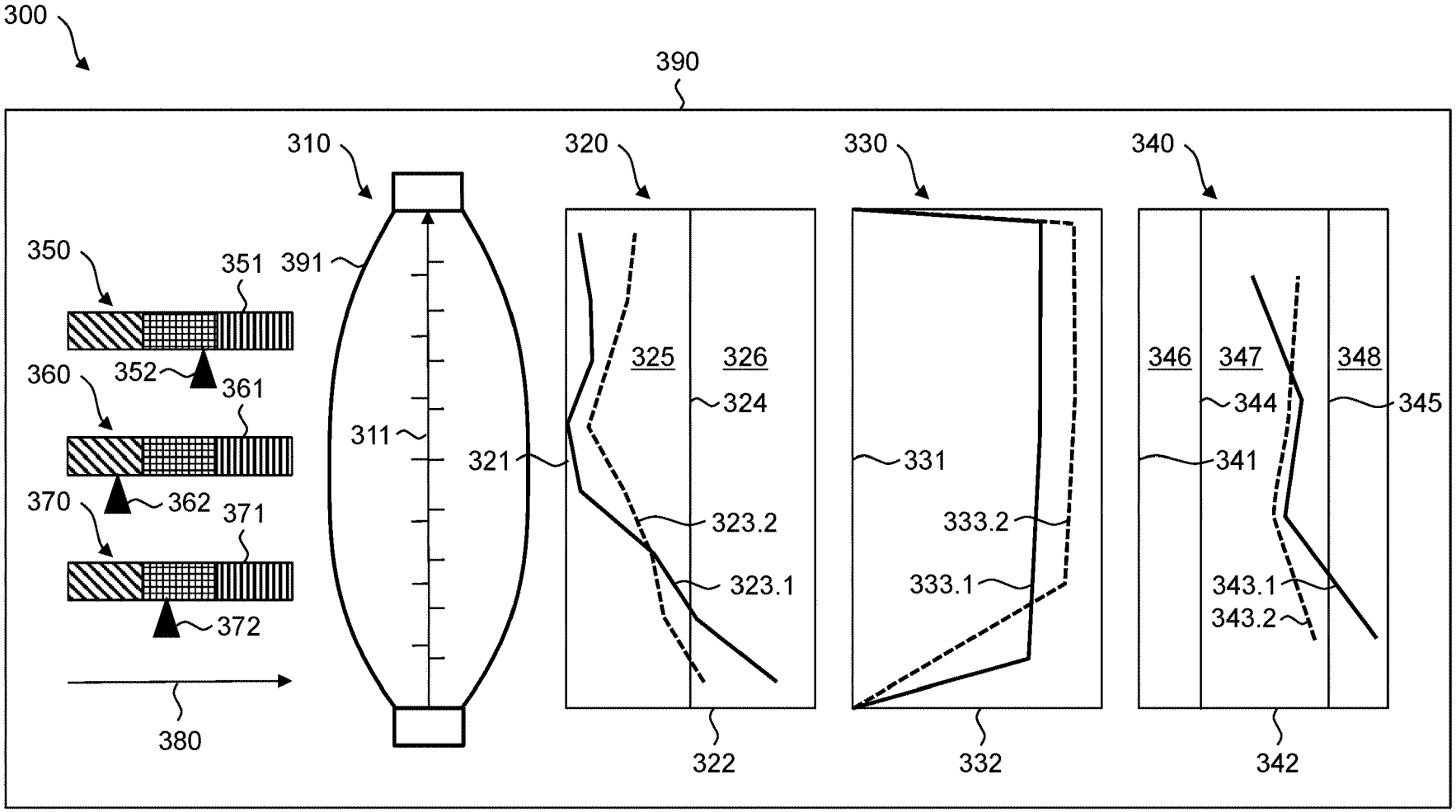

FIG. 3 shows a similar situation as FIG. 2, and corresponding elements are marked with analog reference numerals.

In contrast to the graphical representation 200 of FIG. 2, in the graphical representation 300 of FIG. 3 the two bar charts 220, 240 were replaced by line charts 320, 340. This is to illustrate that the present invention is not limited to certain types of diagrams. Other types of diagrams for the graphical representation of the spinning data and yarn data assigned to each other are possible and known per se. Different types of diagrams can be combined with each other in a graphical representation.

The diagrams 320, 330, 340 refer to two cops that were wound at different times. They each show a first solid line 323.1, 333.1 or 343.1, respectively, which refers to a first cop, and a second dashed line 323.2, 333.2 or 343.2, respectively, which refers to a second cop. Without limiting the generality, we can assume that the second cop was wound after the first cop.

The first diagram 320 is divided by a straight line 324 parallel to the time axis 321 into two areas 325, 326, which define the requirements for the productivity of the spinning position 21. The number of yarn breaks per time unit 322 is permissible in a first area 325 and not permissible in a second area 326. In the example in FIG. 3, the first two parameter values of the first cop (line 323.1) and the first parameter value of the second cop (line 323.2) are not permissible.

The third diagram 340 is divided by two straight lines 344, 345 parallel to the time axis 341 into three areas 346-348, which define the quality requirements for yarn 92. In a first area 346, the number of yarn faults per time unit 342 is so small that the quality requirements are clearly exceeded, which probably has a negative effect on productivity. Therefore, a number of yarn faults per time unit 342 in this first area 346 is undesirable. Ideally, the number of yarn faults per time unit 342 should lie in a second area 347. In a third area 348, on the other hand, the number of yarn faults per time unit 342 is too high and is therefore unacceptable. In the example in FIG. 3, the first parameter value of the first cop (line 343.1) is not permissible.

Figure 4:
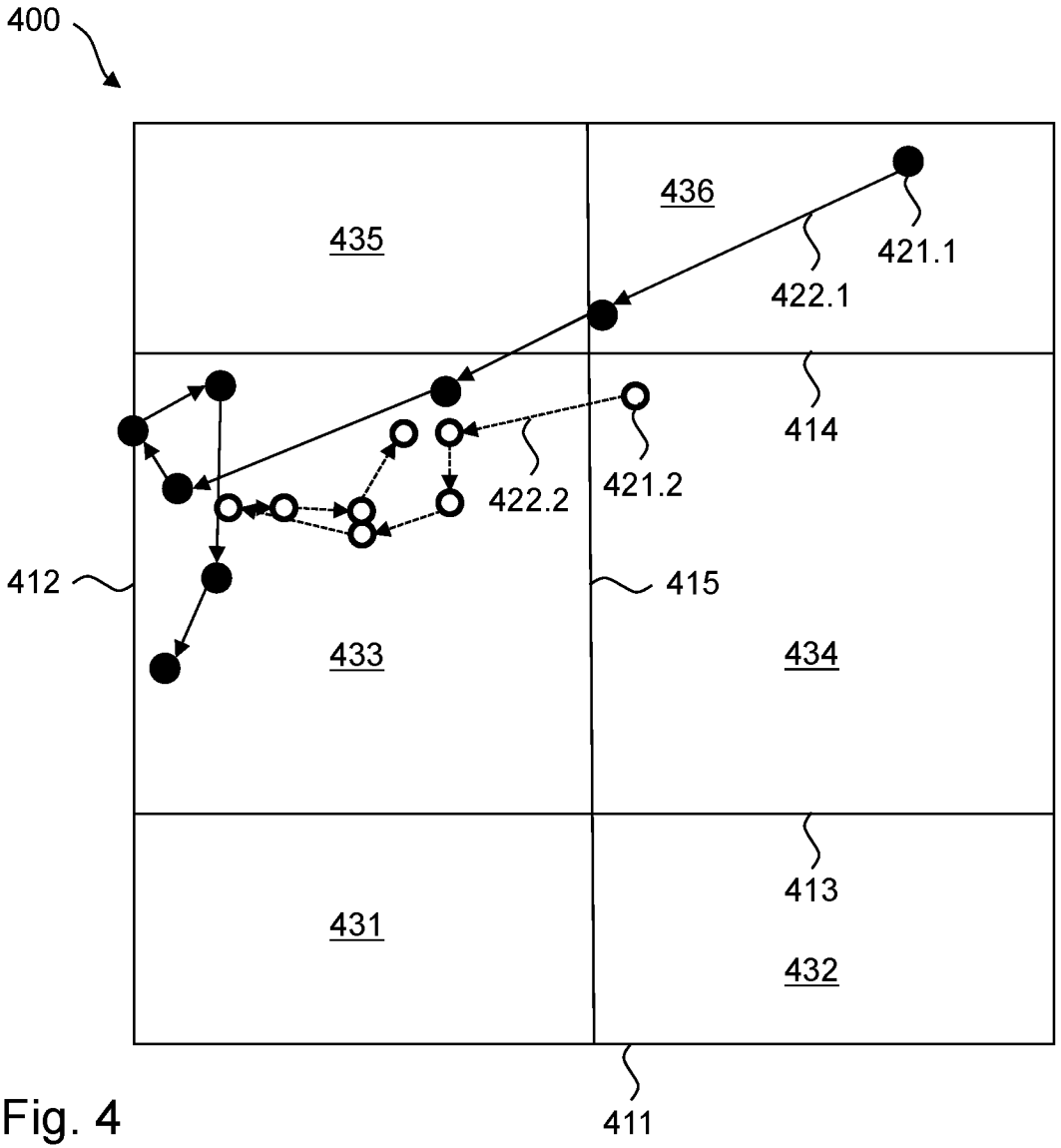

Another graphical representation of the spinning data and yarn data assigned to each other is shown in FIG. 4, where the spinning data and the yarn data assigned to them are not shown in several separate diagrams, but together in a single diagram 400. The two-dimensional diagram 400 is defined by the parameter 411, which is characteristic for the operation of the spinning position, on the one hand, and by the parameter 412, which is characteristic for the yarn, on the other. The values of these two parameters form coordinates of points 421.1, 421.2, which are drawn in diagram 400. If the number and/or the position of the corresponding parameter values drawn in FIGS. 2 and 3 do not match, the respective values can be determined by interpolation and/or extrapolation of the existing values. The diagram 400 in FIG. 4, unlike the diagrams in FIGS. 2 and 3, does not contain an axis corresponding to time. However, the time course can be indicated by arrows 422.1, 422.2 between two consecutive points in time.

Diagram 400 is divided into six areas 431-436 by axis-parallel straight lines 413-415. This subdivision corresponds to that of FIG. 3, where the first diagram 320 is divided by straight line 324 and the third diagram 340 by straight lines 344, 345. Thus, for example, points lying in the area 433 have both a permissible characteristic parameter 411 for the spinning position and a permissible characteristic parameter 412 for the yarn; points in the area 434 have a permissible characteristic parameter 412 for the yarn but an impermissible characteristic parameter 411 for the spinning position; etc.

Examples of a possible intervention on ring spinning machine 2 are indicated below, as it can be carried out according to the invention on the basis of the spinning data and yarn data assigned to each other. The intervention can be performed automatically by the central control and evaluation unit 6 or manually by an operator.

For automatic intervention, the central control and evaluation unit 6 is connected to a control unit of the ring spinning machine 2 and transmits corresponding control signals to it. Such a control unit of ring spinning machine 2 is not shown separately in FIG. 1. In one embodiment, it may coincide with the spinning monitoring control unit 43.

For a manual intervention, one or more recommendations for the intervention can at least be generated automatically and output to the operator in addition to the graphical representation. Such a recommendation can contain several options, e.g.: "Reduce ring traveler speed or replace drafting belts!"

A first look is made concerning the example in FIG. 3. In the first diagram 320, the first two parameter values of the first cop (line 323.1) are in the impermissible area 326. The first parameter value of the same cop in the third diagram 340 is also in the impermissible area 348. The reason for the impermissible parameter values may be that the speed of the ring traveler increases too quickly at the beginning of winding. In order to reduce the number of yarn breaks per time unit 322 and the number of yarn faults per time unit 342 at the beginning of winding, the acceleration of the ring traveler at the beginning of winding is reduced as an intervention at the ring spinning machine 2. To compensate for the time lost as a result, the final speed can be set somewhat higher. The speed profile 333.2, which has been changed in this way compared to the original speed profile 333.1, is shown in the second diagram 330 of FIG. 3.

The effects of this intervention are checked on the basis of the spinning data and yarn data assigned to each other. This is possible as soon as a second cop is wound at the same spinning position 21 as the first cop with the second speed profile 333.2 and rewound at any winding position 31. The spinning data of the second cop is shown in the first diagram 320 with line 323.2, the yarn data in the third diagram 340 with line 343.2. The yarn data are now all within the permissible area 347, so thanks to the intervention, the yarn quality on the second cop is essentially the same, while on the first cop the yarn quality on the lower end of the cop was much worse than on the upper end. If it is possible to maintain the same yarn quality for the cops wound up later, yarn bobbins are also produced without any significant quality variations within the bobbin, which is a great advantage. The first parameter value of the spinning data is still in the impermissible area 326 for the second cop. To further improve the spinning data, a new intervention can be made. This can consist, for example, in a further reduction of the acceleration of the ring traveler at the beginning of winding or in a replacement of the ring traveler. Care is taken to ensure that the yarn data remain within the permissible area 347.

In the diagram 400 of FIG. 4, each of the six areas 431-436 can be assigned a specific intervention on ring spinning machine 2. In addition, the intervention can depend on the time or position of the cop, at which the relevant parameter values were determined. If, for example, points lie in the area 436, the intervention may be intended to reduce the speed of the ring traveler at the relevant time during winding. For points in the area 434, the ring traveler may be replaced if this is necessary (pointer 352 in diagram 350 of FIG. 3 in the second or third area of bar 351), otherwise the speed of the ring traveler is reduced at the relevant point in time. No intervention is necessary for points in the area 433.

If the method according to the invention is carried out several times in succession, there is a closed control loop for the operation of the ring spinning system 1. The controlled variables are the parameter characteristic for the operation of the spinning position 21 and/or the parameter characteristic for the yarn. The target state is that the parameter values are within the permissible areas 325, 347 (FIG. 3) and 433 (FIG. 4). If this is not the case, a certain intervention is made at the ring spinning machine 2 as a regular intervention. The control is relatively slow because it takes at least a time ("doffing time") required for the winding of a cop before the effect of the control intervention can be checked and a new control intervention can be made if necessary. Nevertheless, the control according to the invention solves the object set at the beginning.

It is understood that the present invention is not limited to the embodiments discussed above. With knowledge of the invention, the person skilled in the art will be able to derive further variants which are also part of the subject matter of the present invention. For example, various graphic elements shown in FIGS. 2-4 can be combined with each other to form further graphical representations.

LIST OF REFERENCE NUMERALS

1 Ring spinning system
2 Ring spinning machine
21 Spinning position
22 Transport of a cop from the ring spinning machine to the winding machine
3 Winding machine
31 Winding position
32 Feeding-in of empty cop ring tubes from the winding machine to the ring spinning machine
4 Spinning monitoring system
41 Spinning sensor
42 First data line
43 Spinning monitoring control unit
44 Third data line
45 Spinning expert system
5 Yarn monitoring system
51 Yarn sensor
52 Second data line

53 Yarn monitoring control unit
54 Fourth data line
55 Yarn expert system
6 Central control and evaluation unit
61 Mobile device
91 Cop
92 Yarn
93 Yarn bobbin
200, 300 Graphical representation
210, 310 Display of a cop
211, 311 Cop axis
220, 320 First diagram
221, 321 Time axis
222, 322 Axis of the number of yarn breaks per time unit
223 Bar for number of yarn breaks per time unit
230, 330 Second diagram
231, 331 Time axis
232, 332 Axis of the ring traveler speed
233;
333.1, 333.2 Time course of the ring traveler speed
240, 340 Third diagram
241, 341 Time axis
242, 342 Axis of the number of yarn faults per time unit
243 Bar for yarn defects per time unit
244 Bar for neps
245 Bar for thin places
246 Bar for thick places
250, 260, 270;
350, 360, 370 Diagrams for operating time of components of spinning positions
251, 261, 271;
351, 361, 371 Bars for displaying the operating time of spinning position components
252, 262, 272;
352, 362, 372 Arrows to indicate the operating time of spinning position components
280, 380 Time axis
290, 390 Chart frame
291, 391 Represented cop
323.1, 323.2 Progression of number of yarn breaks per time unit
324 Straight line parallel to time axis
325 Permissible range for number of yarn breaks per time unit
326 Inadmissible range for number of yarn breaks per time unit
343.1, 343.2 Course of the number of yarn faults per time unit
344, 345 Lines parallel to the time axis
346 Undesirable range for number of yarn faults per time unit
347 Desired range for number of yarn faults per time unit
348 Inadmissible range for number of yarn faults per time unit
400 Diagram
411 Axis for spinning parameters
412 Axis for yarn parameters
413-415 Axis-parallel straight lines
421.1, 421.2 Points
422.1, 422.2 Arrows
431-436 Areas with different degrees of desirability and permissibility

The invention claimed is:

1. A method for operating a ring spinning system, comprising a ring spinning machine having a plurality of spinning positions and a winding machine having a plurality of winding positions, wherein:

yarn is spun at one of the spinning positions and wound into a cop, the cop is automatically transported from the spinning position to one of the winding positions, and the yarn is rewound from the cop onto a yarn bobbin at the winding position, characterized in that values of a parameter characteristic for the operation of the spinning position at at least two different times during the winding of the cop are automatically determined and stored as spinning data together with associated first pieces of section information identifying yarn sections wound at the at least two different times, values of a parameter characteristic for the yarn are automatically determined at at least two different times during the rewinding of the cop and stored as yarn data together with associated second pieces of section information identifying yarn sections rewound at the at least two different times, the spinning data and the yarn data are automatically assigned to each other based on the respective first and second pieces of section information in such a way that they relate to the same yarn section, and an intervention is made on the ring spinning machine based on the spinning data and yarn data assigned to each other.

2. The method according to claim 1, wherein:

the yarn is simultaneously spun and wound into cops at the plurality of spinning positions, which cops form a group of cops, the values of the parameter characteristic for the operation of the spinning position are automatically determined for the whole group of cops simultaneously in each case, a mean value of the values of the parameter characteristic for the operation of the spinning position is automatically calculated for the group of cops for each of the different times and these mean values are stored together with associated first section information as spinning data, and a mean value of the values of the parameter characteristic for the yarn is automatically calculated for the same group of cops for each of the different times and these mean values are stored as yarn data together with associated second section information.

3. The method according to claim 1, wherein at least one of the first or second section information contain at least one of:

information on a point in time when the respective yarn section is wound or rewound, or information about a location on the cop where the respective yarn section is located.

4. The method according to claim 1, wherein for performing the step of automatically assigning the spinning data and the yarn data to each other, an identification of a point in time of winding of the cop is assigned to the cop and stored as a key with both the spinning data and the yarn data.

5. The method according to claim 4, wherein for performing the step of automatically assigning the spinning data and the yarn data to each other, an identification of the spinning position is additionally assigned to the cop and stored as a key with both the spinning data and the yarn data.

6. The method according to claim 1, wherein the intervention on the ring spinning machine comprises an action from the following set: changing a spindle speed preset, changing a ring traveler, changing a drafting belt, changing a pressure cylinder, changing the air temperature, changing the air humidity.

7. The method according to claim 1, wherein the parameter characteristic for the operation of the spinning position comprised by the spinning data is selected from the following set: number of yarn breaks per time unit, ring traveler speed, air temperature, air humidity.

8. The method according to claim 1, wherein the parameter characteristic for the yarn comprised in the yarn data is selected from the following set: coefficient of variation of the yarn mass, coefficient of variation of the yarn diameter, hairiness, number of thick places per unit length, number of thin places per unit length, number of periodic yarn defects per unit length, number of yarn number variations per unit length, number of impurities per unit length.

9. The method according to claim 1, wherein the intervention is carried out automatically on the ring spinning machine.

10. The method according to claim 1, wherein the spinning data and yarn data assigned to one another are graphically represented together in a graphical representation and the graphical representation is output to an operator as the basis for the intervention to be carried out on the ring spinning machine.

11. The method according to claim 10, wherein a recommendation for the intervention on the ring spinning machine is automatically generated and, in addition to the graphical representation, is output to the operator.

12. The method according to claim 10, wherein the intervention on the ring spinning machine is carried out by the operator on the basis of the output graphical representation or on the basis of the recommendation.

13. The method according to claim 10, wherein:

the graphical representation of the spinning data contains a diagram of at least two values of the parameter characteristic for the operation of the spinning position as a function of the position along a longitudinal axis of the cop or as a function of the time during the winding of one and the same cop, and the graphical representation of the yarn data contains a diagram of the at least two values of the parameter characteristic of the yarn as a function of the same independent variable as the spinning data.

14. The method according to claim 10, wherein the graphical representation additionally contains a diagram representing a quantity from the following set: operating time of a ring traveler, operating time of a pressure cylinder, operating time of a drafting belt.

15. The method according to claim 1, wherein the operation of the ring spinning system is controlled in a closed control loop, in which control loop at least one of (a) the parameter characteristic for the operation of the spinning position or (b) the parameter characteristic for the yarn, is a controlled variable with a target value within a predetermined target range.

16. A ring spinning system (1), comprising:

a ring spinning machine having a plurality of spinning positions for spinning yarn and for winding the yarn onto an associated plurality of cops, a spinning monitoring system for monitoring the operation of the spinning positions, comprising a spinning sensor at each of the spinning positions for measuring a spinning measured quantity, a winding machine having a plurality of winding positions for rewinding the yarn from a respective cop onto a yarn bobbin, a yarn monitoring system for monitoring properties of the yarn, comprising a yarn sensor at each of the winding positions for measuring a yarn measured quantity, and a transport system for transporting the cop from the spinning position to one of the winding positions, characterized by a spinning monitoring control unit connected to the spinning sensor, which is adapted to receive values of the spinning measured quantity from the spinning sensor of a spinning position, to determine therefrom, at at least two different times during the winding of the cop, values of a parameter characteristic for the operation of the spinning position, and to store the determined values together with associated first pieces of section information identifying yarn sections wound at the at least two different times as spinning data, a yarn monitoring control unit connected to the yarn sensor, which is adapted to receive values of the yarn measured quantity from the yarn sensor of a winding position, to determine therefrom, at at least two different times during the rewinding of a cop in each case, values of a parameter characteristic for the yarn and to store the determined values together with associated second pieces of section information, which identifies yarn sections rewound at the at least two different times, as yarn data, and a central control and evaluation device connected to the spinning monitoring control unit and to the yarn monitoring control unit, which is adapted for the purpose, of receiving the spinning data from the spinning control unit and the yarn data from the yarn monitoring control unit, and of assigning the received spinning data and yarn data to each other on the basis of the respective first and second pieces of section information in such a way that they relate to the same yarn section, thereby providing a basis for intervention on the ring spinning machine.

17. The ring spinning system according to claim 16, wherein the central control and evaluation device is connected to a control unit of the ring spinning machine and is adapted to automatically perform the intervention at the ring spinning machine.

18. The ring spinning machine (1) according to claim 16, wherein the central control and evaluation device is connected to an output unit and is adapted to graphically represent the spinning data and yarn data assigned to each other together in a graphical representation and to output the graphical representation to an operator on the output unit on the output unit as the basis for the intervention to be performed on the ring spinning machine.

19. The ring spinning system according to claim 18, wherein the central control and evaluation device is adapted to automatically generate a recommendation for the intervention at the ring spinning machine and to output it to the operator in addition to the graphical representation.

20. The ring spinning system according to claim 16, wherein the ring spinning system comprises a plurality of spinning monitoring systems, the spinning monitoring control units of which are connected to a spinning expert system which is adapted:

to receive, process and output data from the spinning monitoring control units, and to control the spinning monitoring control units, and which is connected to the central control and evaluation unit.

21. The ring spinning system according to claim 16, wherein the ring spinning system contains a plurality of yarn monitoring systems, the yarn monitoring control units of which are connected to a yarn expert system which is adapted:

to receive, process and output data from the yarn monitoring control units, and to control the yarn monitoring control units, and which is connected to the central control and evaluation unit.

* * * * *